US008668271B2

(12) United States Patent
Genesin et al.

(10) Patent No.: US 8,668,271 B2
(45) Date of Patent: Mar. 11, 2014

(54) MODULAR SEATING SYSTEM

(76) Inventors: Luca Genesin, Camposampiero (IT); Lorenza Maria Baggio, Camposampiero (IT); Lavinia Genesin, Camposampiero (IT); Leonardo Genesin, Camposampiero (IT); Ludovica Genesin, Camposampiero (IT)

( * ) Notice: Subject to any disclaimer, the term of this patent is extended or adjusted under 35 U.S.C. 154(b) by 153 days.

(21) Appl. No.: 13/001,406

(22) PCT Filed: Jul. 6, 2009

(86) PCT No.: PCT/IB2009/052939
§ 371 (c)(1),
(2), (4) Date: Feb. 27, 2011

(87) PCT Pub. No.: WO2010/007555
PCT Pub. Date: Jan. 21, 2010

(65) Prior Publication Data
US 2011/0309666 A1 Dec. 22, 2011

(30) Foreign Application Priority Data
Jul. 14, 2008 (IT) ..... PD2008A0209

(51) Int. Cl.
*A47C 7/02* (2006.01)

(52) U.S. Cl.
USPC ..... 297/440.14; 297/440.1

(58) Field of Classification Search
USPC ..... 297/440.1, 440.14
See application file for complete search history.

(56) References Cited

U.S. PATENT DOCUMENTS

| | | | | |
|---|---|---|---|---|
| 2,693,847 | A * | 11/1954 | Kablotsky | 297/440.14 X |
| 3,201,894 | A * | 8/1965 | Resch | 446/487 |
| 3,550,310 | A * | 12/1970 | Bock-Greissau | 446/85 |
| 3,596,396 | A * | 8/1971 | Thomson | 446/487 |
| 3,669,494 | A * | 6/1972 | Lohmeyer | 297/440.14 |
| 3,773,329 | A * | 11/1973 | Secter | 297/440.14 X |
| 3,811,728 | A * | 5/1974 | Redemske | 297/440.14 |
| 3,836,418 | A * | 9/1974 | Montgomery | 446/487 |
| 3,872,975 | A * | 3/1975 | Silver | 211/195 |
| 3,944,281 | A * | 3/1976 | Piretti | 297/440.14 |
| 4,077,666 | A * | 3/1978 | Heumann | 297/440.14 |
| 4,875,681 | A * | 10/1989 | Ofir | 273/155 |
| 5,267,776 | A | 12/1993 | Fromson | |
| 6,467,205 | B1 * | 10/2002 | Flagg et al. | 40/107 |
| 7,213,885 | B2 * | 5/2007 | White et al. | 297/440.1 |
| 7,419,220 | B2 * | 9/2008 | White et al. | 297/440.14 |
| 7,481,496 | B2 * | 1/2009 | Smith | 297/440.14 |
| 7,547,073 | B2 * | 6/2009 | White et al. | 297/440.1 |
| 7,963,612 | B2 * | 6/2011 | Nelson | 297/440.1 |

(Continued)

FOREIGN PATENT DOCUMENTS

| | | |
|---|---|---|
| DE | 20115671 | 12/2001 |
| EP | 0076874 | 4/1983 |
| FR | 2860167 | 4/2005 |
| WO | 0025637 | 5/2000 |

*Primary Examiner* — Rodney B White
(74) *Attorney, Agent, or Firm* — Themis Law

(57) ABSTRACT

A new seating system with one or more substantially horizontal or inclined seats or supporting surfaces, and/or one or more substantially vertical or inclined backs, includes eight prismatic modular elements or modules with opposite parallel base faces in the shape of right-angled isosceles triangles, each module being joined to at least one adjacent module at the level of one corner, wherein each module is configured to rotate around said connection corner relative to the module to which it is joined.

12 Claims, 5 Drawing Sheets

(56) References Cited

U.S. PATENT DOCUMENTS

2007/0052276 A1* 3/2007 Hurvich ..... 297/440.14
2007/0085406 A1* 4/2007 White et al. ..... 297/440.1
2007/0257539 A1* 11/2007 White et al. ..... 297/440.14
2008/0284228 A1* 11/2008 Smith ..... 297/440.14
2009/0315382 A1* 12/2009 Nelson ..... 297/440.1

* cited by examiner

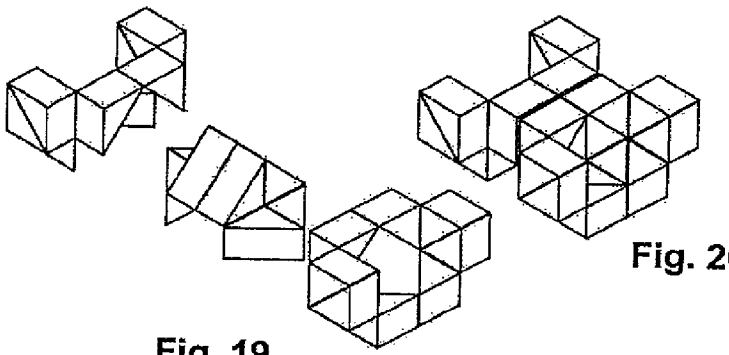
Fig. 19
Fig. 20
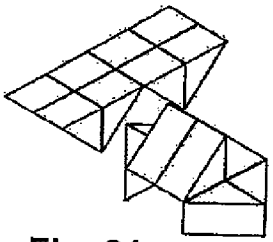
Fig. 21
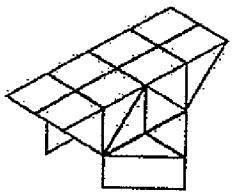
Fig. 22
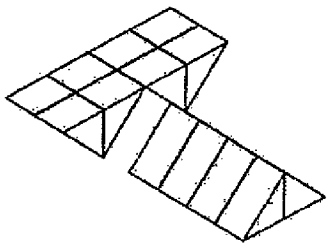
Fig. 23
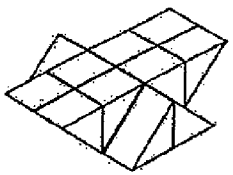
Fig. 24
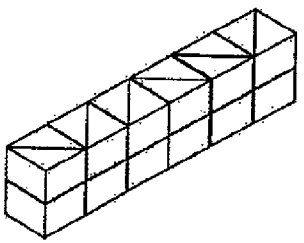
Fig. 25
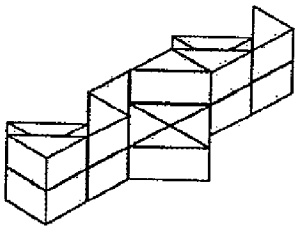
Fig. 26

MODULAR SEATING SYSTEM

FIELD OF THE INVENTION

The present invention concerns the seating sector, and in particular concerns a new modular seating system that can be put together in various ways.

BACKGROUND OF THE INVENTION

Various types of seating systems are known, upholstered or not, with one or more seats.

Upholstered seating systems or sofas are known, which include one or more seats with a substantially horizontal supporting surface and at least one back with a substantially vertical supporting surface.

Seating systems or sofas are known having backs that can be inclined with respect to the seats. Sofa beds are also known, having seats and backs that can be folded and can slide in relation to one another in such a way as to form a substantially horizontal plane serving as a mattress. The upholstered elements that make up upholstered sofas or seats generally comprise a body made of a soft material, typically foam rubber, with or without a stiffening core, for example made of wood or metal, with a covering in fabric of various types or leather.

Non-upholstered seating systems are known, such as seats, stools or benches, which include one or more legs or feet for resting on the ground, a substantially horizontal seat and if necessary a substantially vertical back, connected to said seat in a rigid or reclinable way.

Seats or benches are known which comprise also one or more armrests positioned at the sides of the seat. Said seat and said back can be made of a rigid material, for example plastic, wood or metal, upholstered or not, or of a non rigid material, like cloths stretched between the rigid rods that make up the frame of the seat or bench.

Elements for seating or more generally resting thereon are also known, usually in the shape of a cube, parallelepiped or cylinder, provided with a lower surface resting on the ground, with or without feet, and an opposite upper surface that can serve as a seat, footrest or supporting plane in general.

Said seating elements can be upholstered or not.

SUMMARY OF THE INVENTION

An object of the present invention is a new type of seating system, which can be upholstered or not and can be put together in various ways such to create multiple different three-dimensional configurations.

The main object of the present invention is to allow an immediate recombination of the elements making up the seating system in the available space, such to obtain various different three-dimensional configurations of the seating system.

Another object of the present invention is to provide a seating system that can be configured in a compact shape, for example cubic or parallelepiped, in such a way as to minimize its overall dimensions.

The present invention is particularly but not exclusively suited to be used by children or in places where there are many children, like nursery schools and play centers etc., because it can be used as a piece of furniture, a seating system and even as a game.

The present invention is also particularly suited to be used for furnishing rooms in general, because it can be combined with other seating systems of the same type, having the same or different dimensions. The new seating system that can be put together in various ways comprises in its main parts eight modular elements or modules in the shape of a prism, with base faces in the shape of a right-angled isosceles triangle, each module being connected to at least one adjacent module at the level of a corner, wherein each module rotates with respect to the module to which it is connected around the axis lying on the corner that joins the two modules.

In the preferred solution, each of said modules is joined to two adjacent modules, in such a way as to form a substantially annular structure.

The new seating system can be put together in multiple different configurations, by simply rotating a module in relation to the adjacent one, thus creating seating systems in various shapes, as described here below.

The new seating system can be set up in such a way as to form very compact configurations, with an overall cubic or parallelepiped shape, which occupy little space and therefore can be orderly stored, or more complex configurations, provided with one or more seats, one or more backs and/or one or more armrests. According to the invention, the new seating system can be partially or preferably entirely made of a soft material or can be upholstered.

According to the preferred embodiment of the invention, each of said modules is upholstered and comprises a prismatic body made of a soft material, for example foam rubber, provided with a fabric covering, for example a natural or synthetic fabric, wherein the modules are joined in pairs, for example by means of a single piece of covering cloth or by sewing the edges of the covering along the connection corners.

According to the invention, the modules can be joined to one another also by means of zip fasteners or Velcro (hook and loop) straps, so as to allow them to be separated and then joined again.

It is also possible to combine two or more of said new seating systems in order to create more complex configurations, wherein the seating systems can have the same or a different size.

BRIEF DESCRIPTION OF THE DRAWINGS

The characteristics of the new seating system will be highlighted in greater detail in the following description, with reference to the drawings attached as non-limiting examples.

FIGS. 19-26 show possible configurations obtained by combining two seating systems.

DETAILED DESCRIPTION OF THE INVENTION

In the preferred embodiment of the invention, schematically shown in the figures, the new modular seating system comprises eight generically prism-shaped modules (Ti), preferably prism-shaped with base faces (Tl) in the shape of a right-angled isosceles triangle.

In this embodiment, the hypotenuse of each one of said prismatic modules (Ti) is equal to twice the height of the base face (Tl).

Each of said modules (Ti) is preferably upholstered and comprises a prismatic body (T2) made of a soft material, for example foam rubber, with a natural or synthetic fabric covering (T3).

Each module (Ti) is joined to the adjacent module at the level of a corner (T4), and each module (Ti) rotates in relation to the module to which it is joined around the axis (Tx) lying on the corner (T4) that joins the two modules.

In the examples shown herein, said modules (Ta-Th) are joined in pairs at the level of a corner (T4) so as to form a substantially annular structure.

Figure 1:
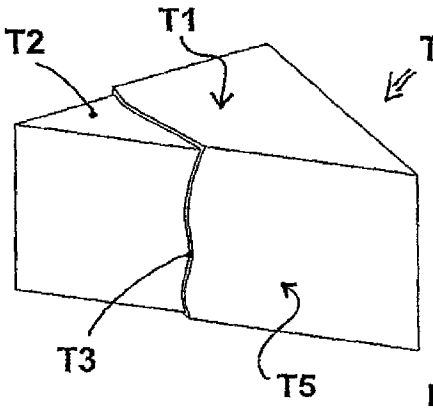
FIG. 1 schematically shows a single module (Ti) of the new modular seating system.
Figure 3:
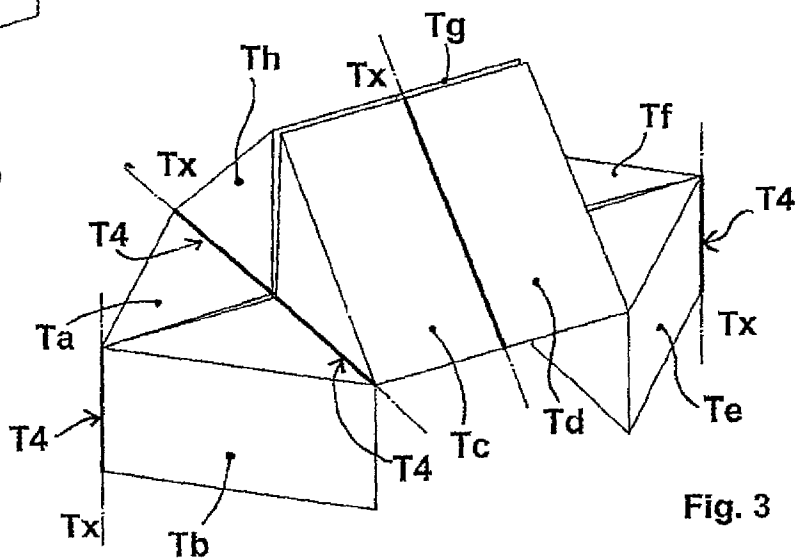
FIGS. 2 and 3 show two examples of possible configurations of a new seating system according to a possible embodiment.
Figure 2:
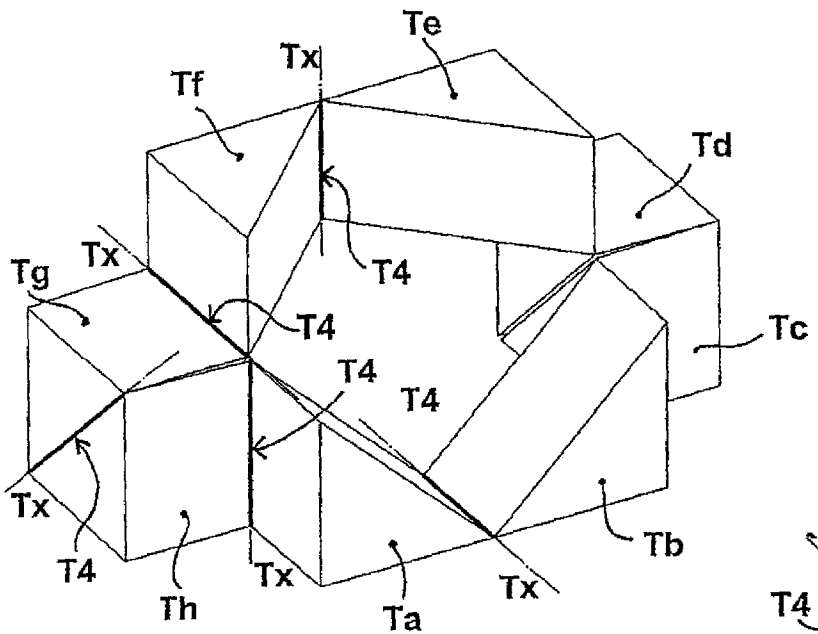

In particular, as shown in FIGS. 2 and 3, a first module (Ta) is joined to the second adjacent module (Tb), in counterclockwise direction, along a corner (T4) of the lateral surface area of the prism; said second module (Tb) is joined to the third module (Tc) along the corner (T4) corresponding to one of the shorter sides of a base face (Tl); said third module (Tc) is joined to the fourth module (Td) along the corner (T4) corresponding to the hypotenuse of a base face (Tl); said fourth module (Td) is joined to the fifth module (Te) along the corner (T4) corresponding to one of the shorter sides of a base face (Tl); said fifth module (Te) is joined to the sixth module (Tf) along the corner (T4) of the lateral surface area of the prism; said sixth module (Tf) is joined to the seventh module (Tg) along the corner (T4) corresponding to one of the shorter sides of a base face (Tl); said seventh module (Tg) is joined to the eighth module (Th) along the corner (T4) corresponding to the hypotenuse of a base face (Tl); and said eighth module (Th) is joined to said first module (Ta) along the corner (T4) corresponding to one of the shorter sides of a base face (Tl).

The new seating system can thus be put together in multiple different configurations, simply by rotating a module (Ti) in relation to the adjacent one around the axis (Tx) lying on the corresponding connection corner (T4), and thus creating seating systems having various shapes.

The new seating system can be put together in such a way as to create very compact configurations, parallelepiped in shape, as shown in FIGS. 9, 10, 11, 12, 14, whose plan size corresponds to the surface area of a square (FIG. 12) whose surface area equals the sum of the surface areas of two triangular base faces (Tl) of the modules (Ti) or whose plan size corresponds to the surface area of four squares placed side by side (FIG. 14), or whose plan size corresponds to the surface area of two squares placed side by side (FIGS. 9, 10), or whose plan size corresponds to the surface area of a square (FIG. 11) whose surface area equals the sum of the surface areas of four triangular base faces (Tl) of the modules (Ti). Said compact configurations create seating systems with one or more seats (O), that is, substantially horizontal supporting surfaces, but without backs (V) or armrests (B).

Figure 15:
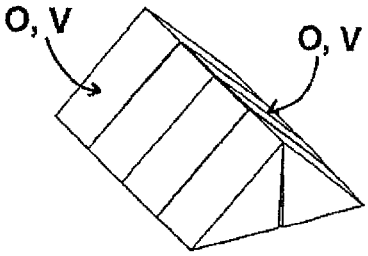
Figure 16:
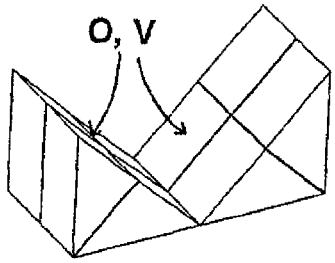
Figure 17:
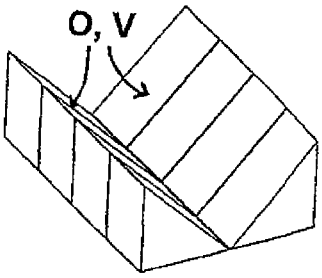
Figure 18:
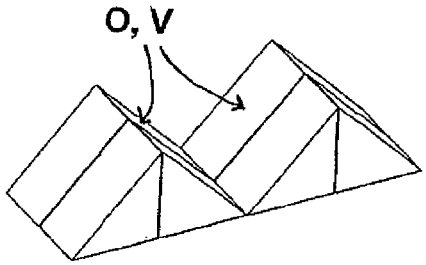

The new seating system can also be put together in such a way as to form configurations that as a whole are prismatic in shape, with triangular cross section (FIG. 15) or cross section consisting of two triangles arranged specularly (FIGS. 16, 17, 18).

Said configurations create seating systems with seats (O) and/or backs (V) inclined at 45 degrees with respect to the ground.

Figure 5:
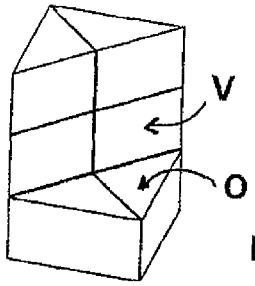
FIGS. 5-18 show 14 possible configurations of the new seating system.
Figure 6:
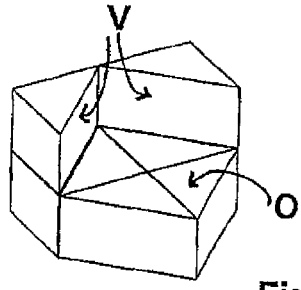
Figure 13:
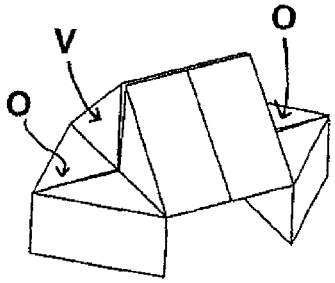
Figure 14:
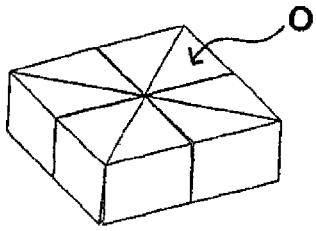

The new seating system can also be put together in such a way as to form more complex configurations, for example in a symmetrical shape consisting of three prisms with triangular base face inclined at 90 degrees with respect to one another (FIG. 4, FIG. 13), where the base faces (Tl), arranged horizontally, of the lateral prisms obtained from two modules (Ta, Tb) and (Te, Tf) placed side by side serve as seats (O), while the base faces (Tl) arranged vertically, of the central prism obtained from two adjoining pairs of modules (Tc, Td) and (Tg, Th) arranged specularly serve as a central back (V) for each one of the two lateral seats (O). As shown in FIGS. 5 and 6, the new seating system may comprise one or more seats (O) obtained from the base faces (Tl) of modules arranged horizontally and one or more backs (V) obtained from the lateral walls (T5) of modules arranged vertically.

Figure 7:
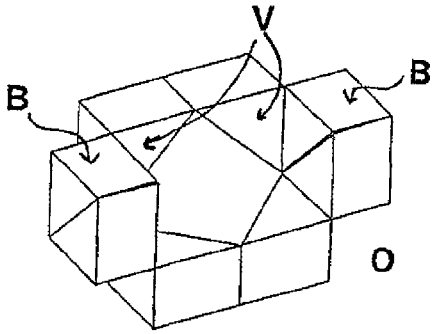
Figure 8:
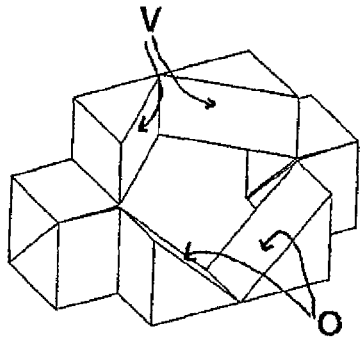
Figure 9:
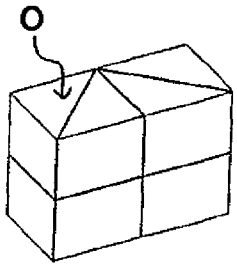
Figure 10:
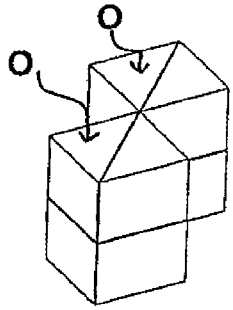
Figure 11:
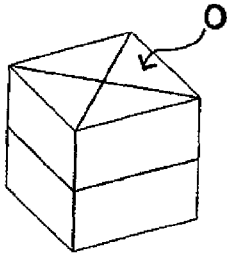
Figure 12:
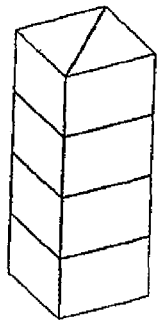

As shown in FIGS. 7 and 8, the new seating system can assume a configuration in which one or more seats (O) are obtained from base faces (Tl) arranged horizontally or from lateral walls (T5) arranged so that they are inclined at 45 degrees with respect to the ground, while one or more backs (V) are obtained from base faces (Tl) arranged vertically or from lateral walls (T5) arranged vertically. The seating systems obtained from said configurations comprise also lateral elements that serve as armrests (B).

According to the invention, it is also possible to combine two or more of said new seating systems, in order to create even more complex configurations, as shown in FIGS. 19-26, where the final configuration obtained (FIGS. 20, 22, 24, 25, 26) has several seats (O) and several backs (V).

Figure 4:
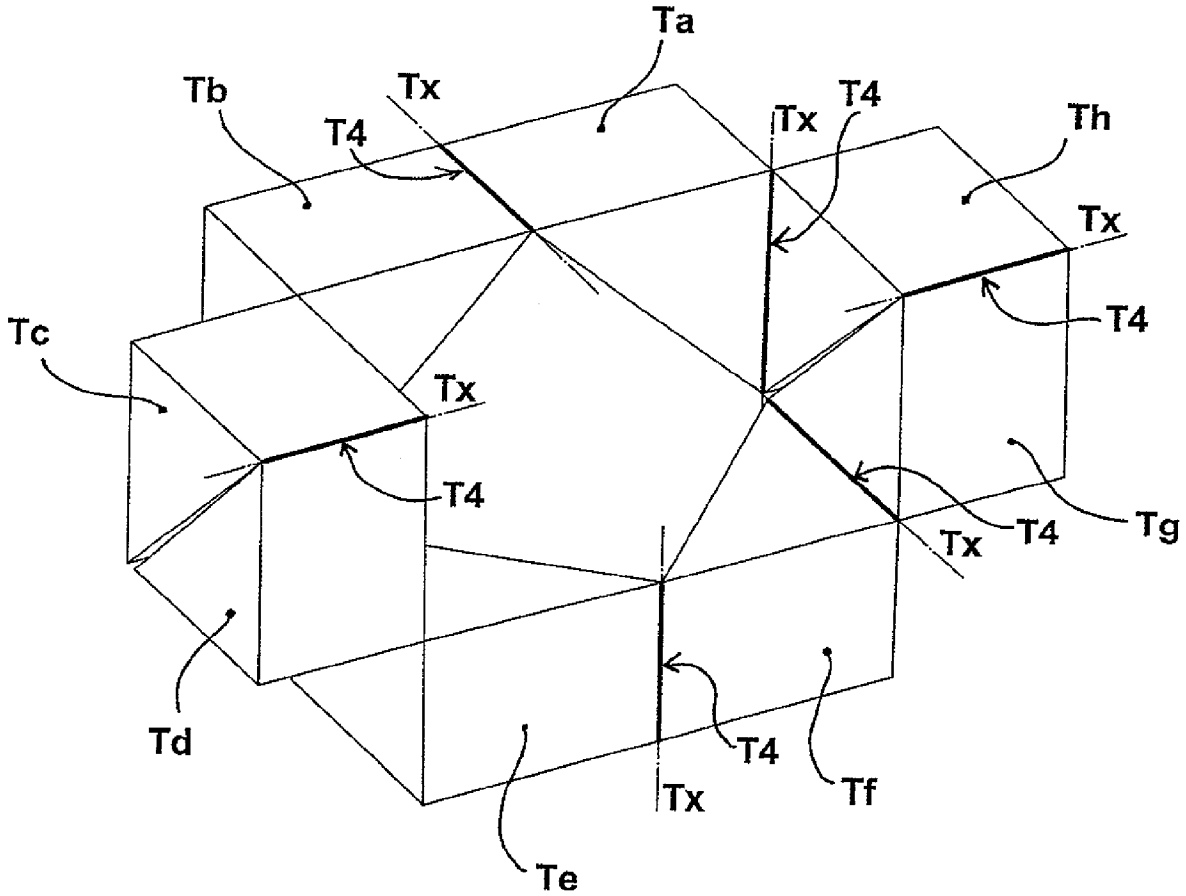
FIG. 4 shows a seating system carried out according to another possible embodiment of the invention, where the modules (Ta-Th) are joined to each other in a different way.

According to another possible solution schematically shown in FIG. 4, said new seating system comprises a first module (Ta) joined to the second adjacent module (Tb), in anticlockwise direction, along a corner (T4) of the lateral surface area of the prism; said second module (Tb) is joined to the third module (Tc) along the corner (T4) corresponding to one of the shorter sides of a base face (Tl); said third module (Tc) is joined to the fourth module (Td) along a corner (T4) of the lateral surface area of the prism; said fourth module (Td) is joined to the fifth module (Te) along the corner (T4) corresponding to one of the shorter sides of a base face (Tl); said fifth module (Te) is joined to the sixth module (Tf) along a corner (T4) of the lateral surface area of the prism; said sixth module (Tf) is joined to the seventh module (Tg) along the corner (T4) corresponding to one of the shorter sides of a base face (Tl); said seventh module (Tg) is joined to the eighth module (Th) along a corner (T4) of the lateral surface area of the prism; and said eighth module (Th) is joined to said first module (Ta) along the corner (T4) corresponding to one of the shorter sides of a base face (Tl).

Also in this case it is possible to create multiple configurations, and said seating system can also be combined with seating systems that are put together in a different way, for example, as previously described, to create complex seating systems having various shapes and dimensions. It is also possible to combine two or more of said seating systems, with the dimensions of the modules (Ti) of a seating system different from the dimensions of the modules (Ti) of a second seating system. For example, the length of the shorter sides of a base face of the modules (Ti) of a seating system can be equal to the length of the hypotenuse of the base face of the modules (Ti) of the second seating system, thus maintaining the same proportions.

Furthermore, always according to the invention, said modules (Ti) can be joined by means of zip fasteners and/or Velcro straps and/or other means that allow the seating system to be disassembled and then reassembled even with modules having different dimensions.

Therefore, with reference to the above description and the attached drawings, the following claims are expressed.

The invention claimed is:

1. A seating system comprising:

one or more support surfaces of the seating system; and eight prismatic modular elements or modules forming the one or more support surfaces, each module having opposite parallel base faces and being shaped as a right-angled isosceles triangular prism, each module further having edge lines, every edge line being configured to be removably coupled to a neighboring module to form connection corners and joined to at least one adjacent module at one connection corner, each edge line having a selectively removable fastener, wherein each module is configured to rotate around said connection corner relative to the at least one adjacent module to which it is joined.

2. The system according to claim 1, wherein each module is joined to two adjacent modules to form a hollow, substantially ring-shaped structure.

3. The seating system according to claim 1, wherein:

a first module is joined to a second adjacent module along a corner of a lateral surface area of the prism;

said second module is joined to a third module along a corner corresponding to one of the shorter sides of a base face;

said third module is joined to a fourth module along a corner corresponding to a hypotenuse of a base face;

said fourth module is joined to a fifth module along a corner corresponding to one of the shorter sides of a base face;

said fifth module is joined to a sixth module along a corner of a lateral surface area of the prism;

said sixth module is joined to a seventh module along a corner corresponding to one of the shorter sides of a base face;

said seventh module is joined to an eighth module along a corner corresponding to a hypotenuse of a base face; and said eighth module is joined to said first module along a corner corresponding to one of the shorter sides of a base face.

4. The seating system according to claim 1, wherein:

a first module is joined to a second adjacent module, in counterclockwise direction, along a corner of a lateral surface area of the prism;

said second module is joined to a third module along a corner corresponding to one of the shorter sides of a base face;

said third module is joined to a fourth module along a corner of a lateral surface area of the prism;

said fourth module is joined to a fifth module along a corner corresponding to one of the shorter sides of a base face;

said fifth module is joined to a sixth module along a corner of a lateral surface area of the prism;

said sixth module is joined to a seventh module along a corner corresponding to one of the shorter sides of a base face;

said seventh module is joined to an eighth module along a corner of the lateral surface area of the prism; and said eighth module is joined to said first module along a corner corresponding to one of the shorter sides of a base face.

5. The seating system according to claim 1, wherein each of said modules is upholstered and comprises a prismatic body made of or covered with a soft material.

6. The seating system according to claim 1, wherein each one of said modules is covered with a covering cloth.

7. The seating system according to claim 6, wherein connection of said modules is obtained using a single covering cloth for all or part of said modules, sewn along the respective connection corners.

8. The seating system according to claim 6, wherein a connection of said modules is obtained by sewing the covering cloth of each module along said corner or by removably joining said modules.

9. The seating system according to claim 1, wherein a height of a prism is equal to twice a hypotenuse of a base face of the prism.

10. The seating according to claim 1, wherein the one or more support surfaces comprise a seat.

11. The seating according to claim 1, wherein the one or more support surfaces comprise a back.

12. The seating according to claim 1, wherein said modules are removably joined with a zip fastener or a hook and loop fastener.

* * * * *